US007953339B2

(12) United States Patent
Fukamachi et al.

(10) Patent No.: US 7,953,339 B2
(45) Date of Patent: May 31, 2011

(54) IMAGE FORMING DEVICE AND CARTRIDGE BEING ELECTRICALLY CONNECTED BY TERMINALS

(75) Inventors: Yasuo Fukamachi, Nagoya (JP); Satoru Ishikawa, Kitanagoya (JP); Fumio Morita, Ichinomiya (JP); Yoshikatsu Kameyama, Gifu-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 553 days.

(21) Appl. No.: 12/048,538

(22) Filed: Mar. 14, 2008

(65) Prior Publication Data

US 2008/0240774 A1 Oct. 2, 2008

(30) Foreign Application Priority Data

Mar. 29, 2007 (JP) ..... 2007-087783

(51) Int. Cl.
*G03G 21/16* (2006.01)

(52) U.S. Cl. ..... 399/90; 399/12; 399/111; 399/113

(58) Field of Classification Search ..... 399/12, 399/90, 113, 111
See application file for complete search history.

(56) References Cited

U.S. PATENT DOCUMENTS 6,898,392 B2 * 5/2005 Karakama et al. ..... 399/90
2001/0014225 A1 * 8/2001 Otsubo et al. ..... 399/24

FOREIGN PATENT DOCUMENTS

JP 10-069140 3/1998

* cited by examiner

*Primary Examiner* — David M Gray
*Assistant Examiner* — G. M. Hyder
(74) *Attorney, Agent, or Firm* — Banner & Witcoff, Ltd.

(57) ABSTRACT

An image forming device according to an aspect includes: a main body; and a first cartridge configured to accommodate a developer and detachably attached to the main body. The first cartridge includes: a rotation body rotatably provided in the first cartridge; a memory device configured to store information concerning the first cartridge; and a first terminal electrically connected to the memory device. The main body includes: a driver configured to rotate the rotation body; and a second terminal electrically connected to the first terminal. The first terminal is provided at a position where a torque produced by rotation of the rotation body acts in the first cartridge.

19 Claims, 4 Drawing Sheets

IMAGE FORMING DEVICE AND CARTRIDGE BEING ELECTRICALLY CONNECTED BY TERMINALS

CROSS-REFERENCE TO RELATED APPLICATIONS

This application is based upon and claims the benefit of priority from Japanese Patent Application No. 2007-087783, filed on Mar. 29, 2007, the entire contents of which are incorporated herein by reference.

TECHNICAL FIELD

This invention relates to an image forming device, such as a laser printer, and a cartridge detachably attachable thereto.

BACKGROUND

An image forming device, such as a laser printer, generally includes a main body and a cartridge detachably attached to the main body.

As an example of such an image forming device, JP-A-10-069140 discloses an electrophotographic image forming device including a process cartridge detachably attachable to a main body. The process cartridge includes a process cartridge connector having an electric device such as IC memory so that necessary information can be input/output to/from the IC memory. The process cartridge connector is exposed so that a connection terminal faces downward. When the process cartridge is attached to the main body, the process cartridge connector is connected to a main body connector. Accordingly, information is transferred between the IC memory and the main body.

In the electrophotographic image forming device described in JP-A-10-069140, the connection state of the process cartridge connector and the main body connector may become unstable due to vibration, etc., occurring at the operating time of the electrophotographic image forming device. Thus, stable transfer of information may be unable to be executed between the IC memory and the main body.

SUMMARY

One aspect of the invention has an object to provide an image forming device capable of transferring information between a memory device of a cartridge and a main body, and a cartridge detachably mountable thereto.

According to an aspect of the invention, there is provided an image forming device comprising: a main body; and a first cartridge configured to accommodate a developer and detachably attached to the main body, wherein the first cartridge comprises: a rotation body rotatably provided in the first cartridge; a memory device configured to store information concerning the first cartridge; and a first terminal electrically connected to the memory device, wherein the main body comprises: a driver configured to rotate the rotation body; and a second terminal connected to the first terminal, and wherein the first terminal is provided at a position where a torque produced by rotation of the rotation body acts in the first cartridge.

According to another aspect of the invention, there is provided a cartridge detachably attachable to an image forming device that comprises a main body, a driver and a second terminal, said cartridge comprising: a rotation body allowed to be rotated by the driver when the cartridge is attached to the image forming device; a memory device configured to store information concerning the cartridge; and a first terminal electrically connected to the memory device, the first terminal being connected to the second terminal when the cartridge is attached to the image forming device, wherein the first terminal is provided at a position where a torque produced by rotation of the rotation body acts in the cartridge.

BRIEF DESCRIPTION OF THE DRAWINGS

FIGS. 4A to 4C show a support portion and a drum first terminal according to a modified example 4 of the embodiment, in which FIG. 4A shows a perspective view of a drum cartridge, FIG. 4B shows a cross-sectional view of the support portion and the drum first terminal, and FIG. 4C shows a cross-sectional view of an alternative example of a support portion and a drum first terminal.

DESCRIPTION

1. General Configuration of Laser Printer

Figure 1:
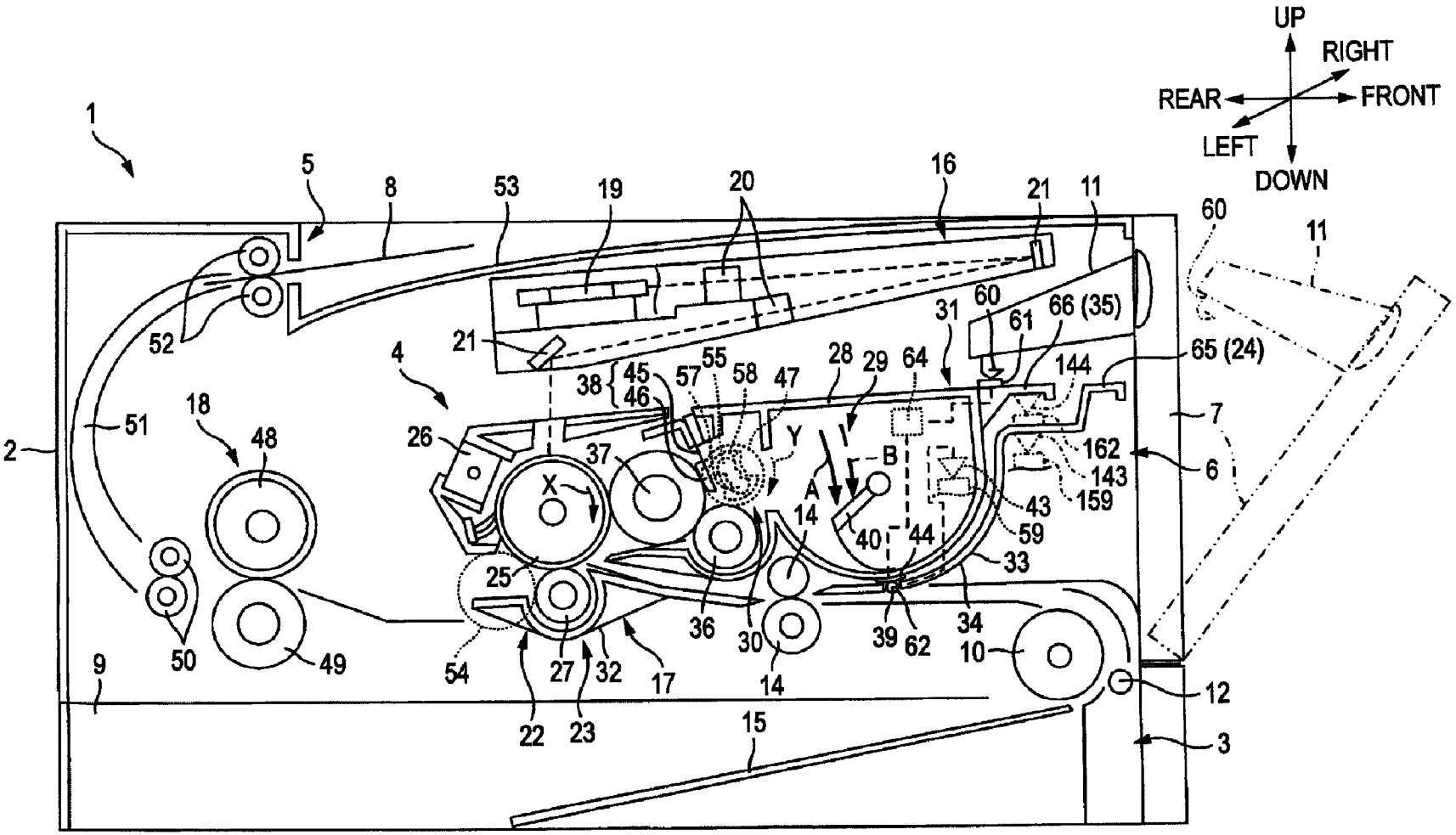
FIG. 1 is a cross-sectional side view to show a laser printer as an example of an image forming device according to one embodiment of the invention.
Figure 2:
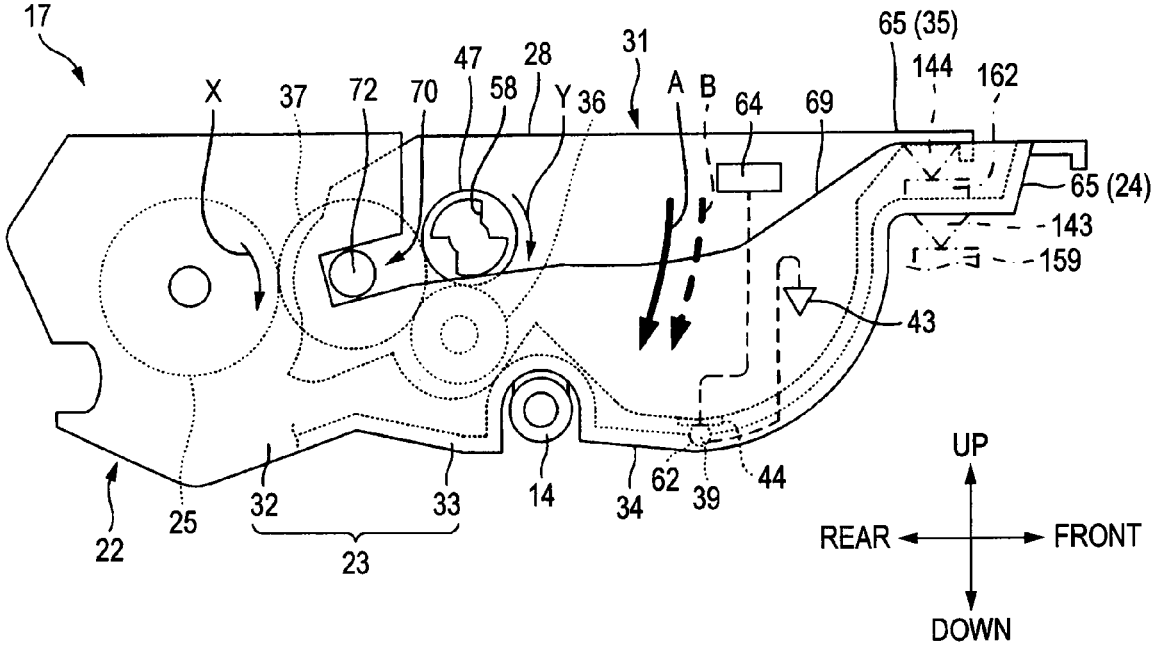
FIG. 2 is a side view of a process cartridge in the laser printer shown in FIG. 1.
Figure 3:
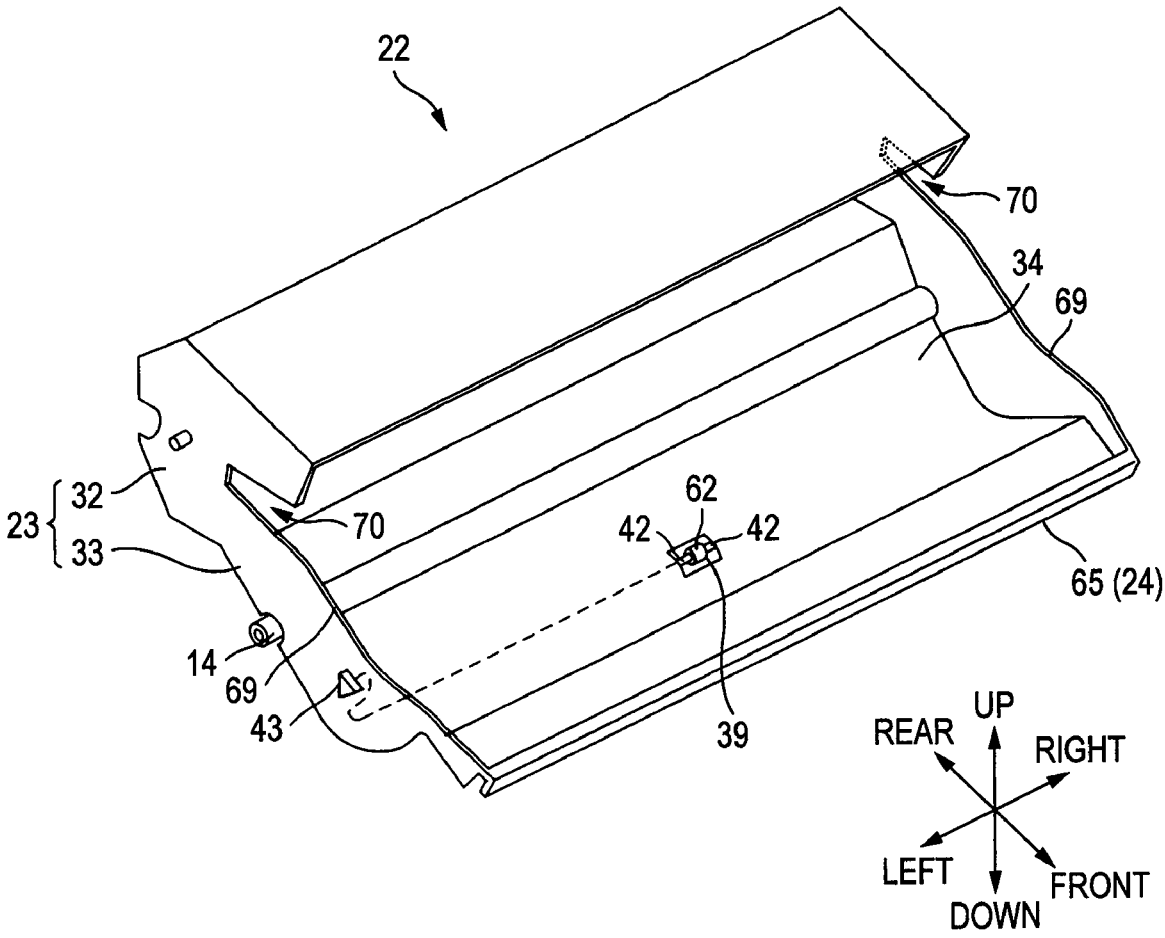
FIG. 3 is a perspective view of a drum cartridge in the process cartridge shown in FIG. 2.

FIG. 1 is a cross-sectional side view to show a laser printer as an example of an image forming device according to an embodiment of the invention. FIG. 2 is a side view of a process cartridge in the laser printer shown in FIG. 1. FIG. 3 is a perspective view of a drum cartridge in the process cartridge shown in FIG. 2.

A laser printer 1 includes: a main body casing 2 as an example of a main body; and a sheet feed unit 3, an image forming unit 4 and a sheet discharge unit 5, which are provided in the main body casing 2 as shown in FIG. 1.

(1) Main Body Casing

The main body casing 2 has a substantially box shape and has an opening 6 as an example of an opening formed through one side wall of the main body casing 2. The main body casing 2 includes a front cover 7, serving as an example of a cover member, for covering the opening 6 and configured to selectively open and close the opening 6. The lower end portion of the front cover 7 is supported on the main body casing 2 to allow the front cover 7 to swingably movable around the lower end portion. When the front cover 7 swings to move toward the opening 6 and is made upright substantially along an up and down direction, the front cover 7 closes the opening 6. On the other hand, when the front cover 7 made upright swings to move away from the opening 6, the front cover 7 opens the opening 6. A process cartridge 17, serving as an example of a first cartridge (described later), is allowed to pass through the opening 6 when the opening 6 is uncovered, whereby it is attached to or detached from the main body casing 2.

In the description to follow, the side where the front cover 7 is provided is "front" and the opposite side is "rear." The front in the sheet thickness direction in FIG. 1 is the left and the back in the sheet thickness direction in FIG. 1 is the right. The left and right direction (side to side direction) is synonymous with the width direction. In the description to follow, the directions concerning the process cartridge 17, a drum cartridge 22, and a developer cartridge 31 are also assumed to be directions in a state where the components are placed in the main body casing 2.

A first drive gear 54 and a second drive gear 55 as an example of a driver are rotatably provided on the right side face of the left wall of the main body casing 2 (face opposed to the attached process cartridge 17). The first drive gear 54 and the second drive gear 55 are joined to a motor (not shown) provided in the main body casing 2. The second drive gear 55 is placed at the front side relative to the first drive gear 54. The second drive gear 55 is provided integrally with a joint projection 57 that projects from the second drive gear 55 to the right side, and the joint projection 57 has a shape of substantially figure of eight in right side view. A main body first terminal 59 as an example of a second terminal is provided on the right side face of the left wall of the main body casing 2 and is placed at the front side relative to the second drive gear 55 (see the dotted line portion in FIG. 1). The main body first terminal 59 is formed of an electrical conductive plate spring having elasticity or the like and projects upward and rightward from the left wall of the main body casing 2. The main body first terminal 59 is connected to a CPU (not shown) provided in the main body casing 2.

(2) Sheet Feed Unit

The sheet feed unit 3 includes a sheet feed tray 9, a sheet feed roller 10, a sheet powder removing roller 12, a pair of registration rollers 14, and a sheet press plate 15. The sheet feed roller 10 is configured to feed a sheet at the top of stack of sheets placed on the sheet press plate 15 one by one at one time. The sheet 8 fed by the sheet feed roller 10 passes through the sheet powder removing roller 12 and the registration rollers 14 and then is conveyed to a transfer position (described later) of the image forming unit 4.

(3) Image Forming Unit

The image forming unit 4 includes a scanner unit 16, the process cartridge 17, and a fixing unit 18.

(3-1) Scanner Unit

The scanner unit 16 is provided in an upper portion of the main body casing 2 and includes a laser beam emission unit (not shown), a rotated polygon mirror 19, a plurality of lenses 20, and a plurality of reflecting mirrors 21. A laser beam emitted from the laser beam emission unit based on image data is reflected on the polygon mirror 19 and then passes through the lenses 20 and reflected on the reflecting mirrors 21. Thereafter, the laser beam is scanned over the surface of a photoconductive drum 25 serving as an example of a rotation body (described later) of the process cartridge 17, as indicated by the dashed line in FIG. 1.

(3-2) Process Cartridge

The process cartridge 17 is detachably attachable to the main body casing 2 and is placed below the scanner unit 16 in the main body casing 2 when the process cartridge 17 is attached to the main body casing 2.

The process cartridge 17 includes the drum cartridge 22 serving as an example of a second cartridge and the developer cartridge 31 serving as an example of a first cartridge. The developer cartridge 31 is detachably attachable to a cartridge storing portion 33 of the drum cartridge 22.

(3-2-1) Drum Cartridge

The drum cartridge 22 has a substantially box shape as shown in FIG. 3. The drum cartridge 22 includes a drum frame 23 forming the contour of the drum cartridge. A roughly rear side half of the drum frame 23 is adopted as a drum storing portion 32 and a roughly front side half is adopted as the cartridge storing portion 33.

The drum storing portion 32 has a substantially box shape with an opening made through both front and rear faces and includes the photoconductive drum 25, a scorotron charger 26, and a transfer roller 27 as shown in FIG. 1.

The photoconductive drum 25 is relatively long in the width direction and is rotatably supported on the drum frame 23. A flange is fitted into both end portions of the photoconductive drum 25 in the width direction thereof and gear teeth are formed on the outer peripheral surface of the left flange. The first drive gear 54 meshes with the gear teeth. Thus, the photoconductive drum 25 is rotated clockwise X in the left side view as a drive force from the motor (not shown) provided in the main body casing 2 is input through the first drive gear 54. When the photoconductive drum 25 is rotated in the direction X, torque (rotation moment) A occurs in the drum cartridge 22 (or the process cartridge 17 in a state where the developer cartridge 31 is attached) to act in a direction along the direction X around the photoconductive drum 25 (see the thick solid arrow in FIGS. 1 and 2).

The scorotron charger 26 is supported on the drum frame 23 with a spacing from the photoconductive drum 25 above the slanting rear of the photoconductive drum 25.

The transfer roller 27 is placed facing the photoconductive drum 25 from below the photoconductive drum 25 and is rotatably supported on the drum frame 23.

The cartridge storing portion 33 is formed to have a closed-end frame with the upper face opened, as shown in FIG. 3. The upper registration roller 14 of the paired registration rollers 14 described above (see FIG. 1) is rotatably supported on the bottom of a bottom wall 34 of the cartridge storing portion 33 and the portion of the bottom wall 34 for supporting the registration roller 14 swells upward.

One support portion 39 is provided at the center position in the width direction of the upper face of the bottom wall 34 and at the center position in the length direction of the photoconductive drum 25 toward the front from the above-mentioned swell portion. The support portion 39 is a roller formed of an electrical conductive material. A support shaft 42 provided on the bottom wall 34 and extending in the width direction is inserted into the circle center of the support portion 39, and the support portion 39 can rotate on the support shaft 42. The support shaft 42 is formed of an electrical conductive material. The support portion 39 rotates while always coming in sliding contact with the support shaft 42. The support portion 39 is provided with a drum first terminal 62 as an example of a third terminal. The drum first terminal 62 is annularly formed of a metal plate having elasticity and electric conductivity, for example, and is attached to the support portion 39 so as to cover the circumferential surface of the support portion 39. In this state, the drum first terminal 62 can become elastically deformed.

The upper end portion of the front end portion of the cartridge storing portion 33 (called drum end portion 65) is an end portion most distant from the photoconductive drum 25 in the rotation radius direction of the photoconductive drum 25 (direction orthogonal to the rotation shaft of the photoconductive drum 25) in the drum cartridge 22 and the process cartridge 17, as shown in FIG. 2. The drum end portion 65 is formed so as to extend toward the front and is adopted as a drum grip 24 as an example of a grip portion. By holding the drum grip 24, the user can grasp the drum cartridge 22 singly or the process cartridge 17 and can attach or detach the cartridge to or from the main body casing 2.

Although not shown, the front portion of the photoconductive drum 25 is exposed to the inside of the cartridge storing portion 33 through an opening formed through the front face of the drum storing portion 32.

The upper end faces of both side walls of the cartridge storing portion 33 in the width direction thereof (called guide rails 69) are formed so as to incline downward rearward. The back ends of the guide rails 69 are connected to the substantially center in the vertical direction of the front ends of both side walls of the drum storing portion 32 in the width direction thereof. A concave portion 70 recessed downward to the slanting rear continuous from the rear end margin of the guide rail 69 is formed on both side walls of the drum storing portion 32 in the width direction thereof. Each concave portion 70 pierces the corresponding width direction side wall in the drum storing portion 32 in the width direction.

In the cartridge storing portion 33, a drum second terminal 43 as an example of a first terminal (see the solid portion in FIG. 2) is provided on the left side face of the left side wall, for example. The drum second terminal 43 is formed of an electrical conductive plate spring having elasticity or the like and projects downward at a distant position in the rotation radius direction of the photoconductive drum 25 from the photoconductive drum 25, more particularly in the proximity of the drum grip 24. That is, since the drum second terminal 43 is at a distant position from the center of the rotation moment A described above, the rotation moment A acts on the drum second terminal 43. In other words, the drum second terminal 43 is provided at a position where the rotation moment A acts in the drum cartridge 22 (the process cartridge 17). The drum second terminal 43 is connected to the drum first terminal 62 through the support shaft 42 (see FIG. 3) and the support portion 39.

(3-2-2) Developer Cartridge

The developer cartridge 31 is detachably attachable to the drum cartridge 22 in the cartridge storing portion 33.

The developer cartridge 31 has a substantially box shape. The developer cartridge 31 includes a developing frame 28 forming the contour of the developer cartridge 31.

As shown in FIG. 1, an opening is formed through the rear face of the developing frame 28, and the inside of the developing frame 28 is partitioned into a toner accommodation chamber 29 on the front and a developing chamber 30 on the rear. The toner accommodation chamber 29 and the developing chamber 30 communicate with each other.

The developing chamber 30 contains a supply roller 36, a developing roller 37, a passive gear 47 as an example of a rotation body, and a layer thickness regulation blade 38.

The developing roller 37 is relatively long in the width direction and is placed so that it is partially exposed from the opening formed through the rear face of the developing frame 28. The developing roller 37 is in contact with the photoconductive drum 25 from the front in a state where the developer cartridge 31 is attached to the drum cartridge 22. The supply roller 36 is placed facing the front of the developing roller 37. The developing roller 37 and the supply roller 36 are rotatably supported on the developing frame 28. Both end portions in the width direction of the rotation shaft of the developing roller 37 (called exposure shaft 72) are exposed to the outside in the width direction from the developing frame 28 (see FIG. 2). A gear is attached to the left of each roller portion of the developing roller 37 and the supply roller 36. Gear teeth are formed on the outer peripheral surface of each gear.

The passive gear 47 is a cylindrical body and is rotatably supported on the left side wall of the developing frame 28. The rotation center of the passive gear 47 extends in the width direction. Gear teeth are formed in the outer peripheral portion of the passive gear 47 and mesh with the gear teeth of each gear of the developing roller 37 and the supply roller 36. The left end face of the passive gear 47 is exposed to the left from the left side wall of the developing frame 28 and is formed with a joint concave portion 58 recessed toward the right side and having a substantially figure eight shape in the left side view (see FIG. 2). The joint projection 57 of the second drive gear 55 described above is joined to the joint concave portion 58. Accordingly, the passive gear 47 is rotated clockwise Y on the left side view (namely, in the same direction as the direction X described above) as a drive force from the motor (not shown) provided in the main body casing 2 is input through the second drive gear 55. The developing roller 37 and the supply roller 36 are rotated as a drive force is transmitted from the passive gear 47 at the mesh position of the gear teeth described above. When the passive gear 47 is rotated in the direction Y, torque (rotation momenta B acting in a direction along the direction Y around the passive gear 47 (see the thick dashed arrow in FIGS. 1 and 2) occurs in the developer cartridge 31.

The layer thickness regulation blade 38 includes a plate spring member 45 formed like a thin plate and press contact rubber 46 provided in a lower end portion of the plate spring member 45. An upper end portion of the plate spring member 45 is fixed to the developing frame 28 and the press contact rubber 46 presses the surface of the developing roller 37 by the elastic force of the plate spring member 45.

As shown in FIG. 2, the upper end portion of the front end portion of the developing frame 28 (called developing end portion 66) is an end portion most distant from the passive gear 47 in the rotation radius direction of the passive gear 47 (direction orthogonal to the rotation shaft of the passive gear 47) in the developer cartridge 31. The developing end portion 66 is formed so as to extend toward the front and is adopted as a developing grip 35 as an example of a grip portion. By holding the developing grip 35, the user can grasp the developer cartridge 31 and can attach or detach the cartridge to or from the drum cartridge 22.

A developing first terminal 44 as an example of a first terminal (see the dotted line portion in the figure) is provided at the center position in the width direction of the bottom of the developing frame 28, and a memory device 64 is provided on the left side face of the developing frame 28. The developing first terminal 44 is formed of an electrical conductive plate spring having elasticity or the like and projects downward. The developing first terminal 44 is provided at a distant position in the rotation radius direction of the passive gear 47 from the passive gear 47. That is, since the developing first terminal 44 is at a distant position from the center of the rotation moment B, the rotation moment B acts on the developing first terminal 44. In other words, the developing first terminal 44 is provided at a position where the rotation moment B acts in the developer cartridge 31.

The memory device 64 is memory for storing information concerning the developer cartridge 31 (for example, the toner accommodation amount, etc.,) in such a manner that the information can be read and can be written. The developing first terminal 44 is electrically connected to the memory device 64. The memory device 64 and the developing first terminal 44 may be formed in one piece, i.e., the developing first terminal 44 may be integrated with the memory device 64.

An agitator is rotatably provided in the toner accommodation chamber 29 as shown in FIG. 1. Nonmagnetic single-component toner having positive electrostatic property as an example of a developer is accommodated in the toner accommodation chamber 29.

To attach the developer cartridge 31 to the drum cartridge 22, the developer cartridge 31 is inserted into the cartridge storing portion 33 of the drum cartridge 22 with the developer cartridge 31 downward to the slanting rear. At this time, each exposure shaft 72 is guided along the guide rail 69 as shown in FIG. 2. When each exposure shaft 72 passes through the guide rail 69 and is attached to the corresponding concave portion 70 and the developing frame 28 is placed on the support portion 39, attachment of the developer cartridge 31 to the drum cartridge 22 is complete. The developer cartridge 31 attached to the drum cartridge 22 is supported on three points by the concave portions 70 and the support portion 39. When the developer cartridge 31 is attached to the drum cartridge 22, the developing first terminal 44 abuts the drum first terminal 62 from above along the acting direction (direction Y) of the rotation moment B described above. Accordingly, the developing first terminal 44 and the drum first terminal 62 are electrically connected and thus the drum second terminal 43 and the memory device 64 are electrically connected through the developing first terminal 44 and the drum first terminal 62. When the drum cartridge 22 to which the developer cartridge 31 is attached, namely, the process cartridge 17 is attached to the main body casing 2, the drum second terminal 43 abuts the main body first terminal 59 from above along the acting direction (direction X) of the rotation moment A described above. Accordingly, the drum second terminal 43 and the main body first terminal 59 are electrically connected and thus the developing first terminal 44 and the main body first terminal 59 are relayed by the drum first terminal 62 and the drum second terminal 43 and the CPU (not shown) and the memory device 64 are electrically connected. In this state, the CPU (not shown) can read the information stored in the memory device 64 and can rewrite the information stored in the memory device 64 in response to the image formation operation. When an image is formed, as the photoconductive drum 25 is rotated, the rotation moment A occurs and the drum second terminal 43 is pressed against the main body first terminal 59 along the acting direction of the rotation moment A. As the passive gear 47 is rotated, the rotation moment B occurs and the developing first terminal 44 is pressed against the drum first terminal 62 along the acting direction of the rotation moment B. Although not shown, wiring to ground the memory device 64 is provided between the memory device 64 and the main body first terminal 59, in addition to electric connection of the CPU (not shown) and the memory device 64.

On the other hand, if the process cartridge 17 is detached from the main body casing 2, the drum second terminal 43 is brought away from the main body first terminal 59 and thus the electric connection of the drum second terminal 43 and the main body first terminal 59 is eliminated. To detach the developer cartridge 31 from the drum cartridge 22, the developer cartridge 31 is pulled out upward to the slanting front from the cartridge storing portion 33 as shown in FIG. 2. At this time, the exposure shaft 72 is detached from the concave portion 70 and is guided along the guide rail 69. As the developing first terminal 44 is brought away from the drum first terminal 62, the electric connection of the developing first terminal 44 and the drum first terminal 62, namely, the electric connection of the drum second terminal 43 and the memory device 64 is eliminated. When the exposure shaft 72 is detached from the guide rail 69 and the developer cartridge 31 is completely drawn out from the cartridge storing portion 33, detaching the developer cartridge 31 from the drum cartridge 22 is complete.

(3-2-3) Developing and Transfer Operation

The toner in the toner accommodation chamber 29 is agitated by rotation of the agitator 40 and is released into the developing chamber 30 and is supplied to the supply roller 36, as shown in FIG. 1. The toner supplied to the supply roller 36 is supplied to the developing roller 37 by rotation of the supply roller 36. At this time, the toner is frictionally charged to the positive polarity between the supply roller 36 and the developing roller 37. Subsequently, the toner supplied to the developing roller 37 enters the nip between the press contact rubber 46 and the developing roller 37 with rotation of the developing roller 37 and is carried on the surface of the developing roller 37 as a thin layer while the layer thickness is regulated between the press contact rubber 46 and the developing roller 37.

The surface of the photoconductive drum 25 first is positively charged uniformly by the scorotron charger 26 with rotation of the photoconductive drum 25 and then is exposed to light by a laser beam from the scanner unit 16 and an electrostatic latent image based on the image data is formed. Next, when the toner carried on the surface of the developing roller 37 faces the photoconductive drum 25 and comes in contact therewith by rotation of the developing roller 37, the toner is supplied to the electrostatic latent image formed on the surface of the photoconductive drum 25. Accordingly, the electrostatic latent image is developed (is made visible) and the toner image is carried on the surface of the photoconductive drum 25. The toner image is transferred onto the sheet 8 passed through the lower side of the bottom wall 34 described above and conveyed to the nip between the photoconductive drum 25 and the transfer roller 27 (transfer position). The sheet 8 onto which the toner image is transferred is conveyed to the fixing unit 18.

(3-3) Fixing Unit

The fixing unit 18 is provided at the rear of the process cartridge 17. The fixing unit 18 includes a heating roller 48, a pressurization roller 49 pressed against the heating roller 48 from below, and a pair of conveying rollers 50 placed at the rear of them.

In the fixing unit 18, the toner transferred onto the sheet 8 at the transfer position is thermally fixed while the sheet 8 passes through the nip between the heating roller 48 and the pressurization roller 49 and then the sheet 8 is conveyed to the sheet discharge unit 5 by the pair of conveying rollers 50.

(4) Sheet Discharge Unit

The sheet discharge unit 5 includes a sheet discharge path 51, a sheet discharge roller 52, and a sheet discharge tray 53. The sheet 8 conveyed from the fixing unit 18 to the sheet discharge path 51 is conveyed from the sheet discharge path 51 to the sheet discharge roller 52 and is discharged onto the sheet discharge tray 53 by the sheet discharge roller 52.

2. Function and Effect of the Embodiment

In the laser printer 1, when the developer cartridge 31 is attached to the drum cartridge 22, the developing first terminal 44 abuts the drum first terminal 62 and is electrically connected to the drum first terminal 62. Accordingly, the memory device 64 and the drum second terminal 43 are electrically connected. When the process cartridge 17 is attached to the main body casing 2, the main body first terminal 59 in the main body casing 2 is connected to the drum second terminal 43 of the process cartridge 17 and the developing first terminal 44 and the main body first terminal 59 are electrically connected. Accordingly, the memory device 64 and the CPU (not shown) in the main body casing 2 are electrically connected and information can be transferred between the memory device 64 and the CPU (not shown).

Thus, the drum first terminal 62 relays the developing first terminal 44 and the main body first terminal 59. Accordingly, attaching the developer cartridge 31 to the drum cartridge 22 and attaching the drum cartridge 22 (process cartridge 17) to the main body casing 2 allows the drum first terminal 62 to be electrically connected to both the developing first terminal 44 and the main body first terminal 59, thereby the developing first terminal 44 can be reliably electrically connected to the main body first terminal 59.

When the image is formed, if the first drive gear 54 in the main body casing 2 rotates the photoconductive drum 25 of the process cartridge 17, rotation moment A occurs. The drum second terminal 43 is provided at a position where the rotation moment A acts in the process cartridge 17. Thus, the rotation moment A causes the drum second terminal 43 to be connected to the main body first terminal 59 at all times.

When the second drive gear 55 in the main body casing 2 rotates the passive gear 47 of the developer cartridge 31, rotation moment B occurs. The developing first terminal 44 is provided at a position where the rotation moment B acts in the developer cartridge 31. Thus, the rotation moment B causes the developing first terminal 44 to be connected to the drum first terminal 62 at all times.

Thus, the rotation moments A and B cause the developing first terminal 44 to be connected to the main body first terminal 59 at all times.

Consequently, the developing first terminal 44 can be stably connected to the main body first terminal 59 and information can be stably transferred between the memory device 64 and the CPU (not shown) in the main body casing 2.

The rotation moment A of the photoconductive drum 25 can be used to stably connect the drum second terminal 43 to the main body first terminal 59. The rotation moment B of the passive gear 47 can be used to stably connect the developing first terminal 44 to the drum first terminal 62.

Since the drum first terminal 62 is provided at the support portion 39 for supporting the developer cartridge 31 attached to the drum cartridge 22, a component intended only for providing the drum first terminal 62 can be omitted and the number of components can be reduced. The support portion 39 is a portion pressed by the developer cartridge 31 as the support portion 39 supports the developer cartridge 31. Particularly, when the passive gear 47 is rotated, the support portion 39 receives the developer cartridge 31 on which the rotation moment B acts. Therefore, as compared with that when the passive gear 47 is still, a larger press force is applied to the support portion 39 from the developer cartridge 31. Thus, the drum first terminal 62 provided at the support portion 39 is reliably connected to the developing first terminal 44.

One support portion 39 is provided at the center position in the length direction (axial direction) of the photoconductive drum 25 in the drum cartridge 22. Thus, the developer cartridge 31 attached to the drum cartridge 22 can be supported on three points by the left and right concave portions 70 and the support portion 39 and can be supported in a stable attitude without looseness (see FIG. 3).

At least one of the drum second terminal 43 and the main body first terminal 59 has elasticity. At least one of the developing first terminal 44 and the drum first terminal 62 has elasticity. Thus, even if an impact force is applied in a state where the main body first terminal 59 is connected to the drum second terminal 43 and the drum first terminal 62 is connected to the developing first terminal 44, namely, in a state where the main body first terminal 59 is connected to the developing first terminal 44, the impact can be cushioned. Accordingly, the developing first terminal 44 can be stably connected to the main body first terminal 59.

3. MODIFIED EXAMPLES

(1) Modified Example 1

In the embodiment described above, the developing first terminal 44 is electrically connected to the memory device 64. In addition, a developing second terminal 61 electrically connected to the memory device 64 may be provided at the developer cartridge 31 as an example of a fourth terminal. The developing second terminal 61 is formed of an electrical conductive plate spring having elasticity or the like and projects upward on the upper face of the developing frame 28.

A main body second terminal 60 connected to the developing second terminal 61 is provided at the main body casing 2 as an example of a fifth terminal. In this case, a projection 11 projecting toward the opening 6 is provided in the upper portion of the front cover 7 and the main body second terminal 60 is projected downward from the projection 11. The main body second terminal 60 is formed of an electrical conductive plate spring having elasticity or the like and is connected to the CPU (not shown) described above like the main body first terminal 59.

When the front cover 7 is closed (see the solid line portion in FIG. 1), the projection 11 is placed above the developer cartridge 31 and the main body second terminal 60 abuts the developing second terminal 61 from above, more particularly, along the direction in which rotation moments A and B act (directions X and Y). Accordingly, the main body second terminal 60 and the developing second terminal 61 are electrically connected and thus the CPU (not shown) and the memory device 64 are electrically connected. On the other hand, when the front cover 7 is opened (see the alternate long and two short dashes line portion in FIG. 1), the main body second terminal 60 is brought away from the developing second terminal 61 and thus the electric connection of the main body second terminal 60 and the developing second terminal 61 is eliminated. The positions of the main body first terminal 59 and the main body second terminal 60 may be replaced so that the front cover 7 may be provided with the main body first terminal 59 rather than the main body second terminal 60.

Thus, the main body second terminal 60 in the main body casing 2 abuts the developing second terminal 61 electrically connected to the memory device 64 in the developer cartridge 31 and is electrically connected to the developing second terminal 61. Accordingly, the memory device 64 and the CPU (not shown) in the main body casing 2 are electrically connected and thus information can also be transferred between the memory device 64 and the main body casing 2 as the main body second terminal 60 abuts the developing second terminal 61 in addition to the case where the main body first terminal 59 is connected to the developing first terminal 44.

The main body second terminal 60 abuts the developing second terminal 61 along the direction in which the rotation moments A and B act (directions X and Y). Accordingly, the developer cartridge 31 and the process cartridge 17 can be prevented from moving in an opposite direction to the direction in which the rotation moments A and B act and the developing first terminal 44 (more particularly, the drum second terminal 43) can be stably connected to the main body first terminal 59.

Since at least one of the developing second terminal 61 and the main body second terminal 60 has elasticity, when the main body second terminal 60 abuts the developing second terminal 61, if a shock occurs, it can be lightened. Accordingly, the main body second terminal 60 can be stably abutted against the developing second terminal 61.

At least one of the main body first terminal 59 and the main body second terminal 60 is provided on the front cover 7. Thus, at least one of a component intended only for providing the main body first terminal 59 and a component intended only for providing the main body second terminal 60 can be omitted and the number of components can be reduced.

When the front cover 7 closes the opening 6, if at least one of the main body first terminal 59 and the main body second terminal 60 is connected to the corresponding terminal, information can be transferred between the memory device 64 and the CPU (not shown) in the main body casing 2 at the same time as the front cover 7 closes the opening 6. Thus, operability can be improved.

(2) Modified Example 2

In the embodiment described above, the developing first terminal 44 is provided on the bottom face of the developing frame 28 and the drum first terminal 62 is provided at the support portion 39 of the bottom wall 34 of the cartridge storing portion 33. In modified example 2, instead, a developing first terminal 144 may be provided at the developing grip 35 (namely, the developing end portion 66) and the drum first terminal 162 may be provided at the drum grip 24 (namely, the drum end portion 65) as indicated by the alternate long and short dashed lines in FIGS. 1 and 2. In particular, the developing first terminal 144 is projected downward from the bottom face of the developing grip 35 and the drum first terminal 162 is projected upward from the upper face of the drum grip 24. The developing grip 35 is placed above the drum grip 24 in a state where the developer cartridge 31 is attached to the drum cartridge 22. Thus, if the developer cartridge 31 is attached to the drum cartridge 22, the developing first terminal 144 abuts the drum first terminal 162 from above (namely, along the direction in which the rotation moment B acts) and the developing first terminal 144 and the drum first terminal 162 are electrically connected.

The drum second terminal 143 may be provided at the drum grip 24. Specifically, the drum second terminal 143 is projected downward from the bottom face of the drum grip 24 as indicated by the alternate long and short dashed line in FIGS. 1 and 2 in addition to projecting the drum first terminal 162 upward from the upper face of the drum grip 24 as described above. Accordingly, the main body first terminal 159 is also moved to a position it can abut the drum second terminal 43.

Thus, the developing first terminal 144 is provided in the developing end portion 66 most distant from the passive gear 47 in the rotation radius direction of the passive gear 47 in the developer cartridge 31. Accordingly, in the developing first terminal 144, the rotation moment B produced by the passive gear 47 can be caused to occur largest. Thus, the developing first terminal 144 can be connected to the drum first terminal 162 by a larger press force.

The drum second terminal 143 is provided in the drum end portion 65 most distant from the photoconductive drum 25 in the rotation radius direction of the photoconductive drum 25 in the process cartridge 17. Accordingly, in the drum second terminal 143, the rotation moment A produced by the photoconductive drum 25 can be caused to occur largest. Thus, the drum second terminal 143 can be connected to the main body first terminal 159 by a larger press force.

Consequently, the developing first terminal 144 and the main body first terminal 159 can be connected still more stably.

Since the developing end portion 66 is the developing grip 35 for the user to grasp the developer cartridge 31, the developing first terminal 144 is provided in the developing grip 35, whereby a component intended only for providing the developing first terminal 144 can be omitted. Likewise, since the drum end portion 65 is the drum grip 24 for the user to grasp the process cartridge 17 (drum cartridge 22), the drum second terminal 143 is provided in the drum grip 24, whereby a component intended only for providing the drum second terminal 143 can be omitted.

Consequently, the number of components can be reduced.

In FIGS. 1 and 2, the drum second terminal 43, the developing first terminal 44, the main body first terminal 59 and the drum first terminal 62 of the embodiment are shown together with the drum second terminal 143, the developing first terminal 144, the main body first terminal 159 and the drum first terminal 162 of the modified example 2. However, only one of a group of terminals 43, 44, 59, 62 and a group of terminals 143, 144, 159, 162 may be provided in the laser printer 1.

(3) Modified Example 3

In the embodiment described above, as the process cartridge 17, the drum cartridge 22 and the developer cartridge 31 is separated. However, the drum cartridge 22 and the developer cartridge 31 may be combined into one piece. In this case, the memory device 64 is electrically connected to the drum second terminal 43 directly, i.e., not via the developing first terminal 44 and the drum first terminal 62. The information concerning the process cartridge 17 stored in the memory device 64 may contain not only the information concerning the developer cartridge 31 described above, but also information concerning the drum cartridge 22 (for example, drive condition of the photoconductive drum 25, etc.,).

In the embodiment described above, the toner accommodation chamber 29 and the developing chamber 30 are provided in the developing frame 28 of the developer cartridge 31. The portion corresponding to the toner accommodation chamber 29 may be formed as an independent toner cartridge. In this case, the toner cartridge may be attached to and detached from the developing frame 28 or may be attached to and detached from the drum frame 23 including the developing frame 28 integrally. The toner cartridge may function as an example of a first cartridge. In particular, the toner cartridge is provided with a memory device storing information concerning the toner cartridge and a terminal electrically connected to the memory device (called toner terminal). The developing frame 28 and the drum frame 23 are provided with a terminal electrically connected to the main body first terminal 59 (called frame terminal) corresponding to the toner terminal, and when the toner cartridge is attached to the developing frame 28 or the drum frame 23, the frame terminal is abutted against the toner terminal and relays the toner terminal and the main body first terminal 59. Accordingly, the toner terminal is electrically connected to the main body first terminal 59 and information can be transferred between the CPU (not shown) in the main body casing 2 and the memory device of the toner cartridge. For example, the toner terminal is provided at a position where torque (rotation moment) of the agitator 40 in the toner accommodation chamber 29 acts in the toner cartridge, whereby the toner terminal can be stably connected to the main body first terminal 59 using the rotation moment of the agitator 40.

As another embodiment, a photoconductive drum 25, a scorotron charger 26, and a transfer roller 27 maybe provided in a main body casing 2 and a developer cartridge 31 may be detachably attachable to the main body casing 2. In this case, a developing first terminal 44 and a main body first terminal 59 are directly electrically connected. A supply roller 36, a developing roller 37, and a layer thickness regulation blade 38 can further be provided in the main body casing 2 and the above-described toner cartridge may be detachably attachable to the main body casing 2. In this case, the above-described toner terminal and the main body first terminal 59 are directly electrically connected.

(4) Modified Example 4

Figure 4A:
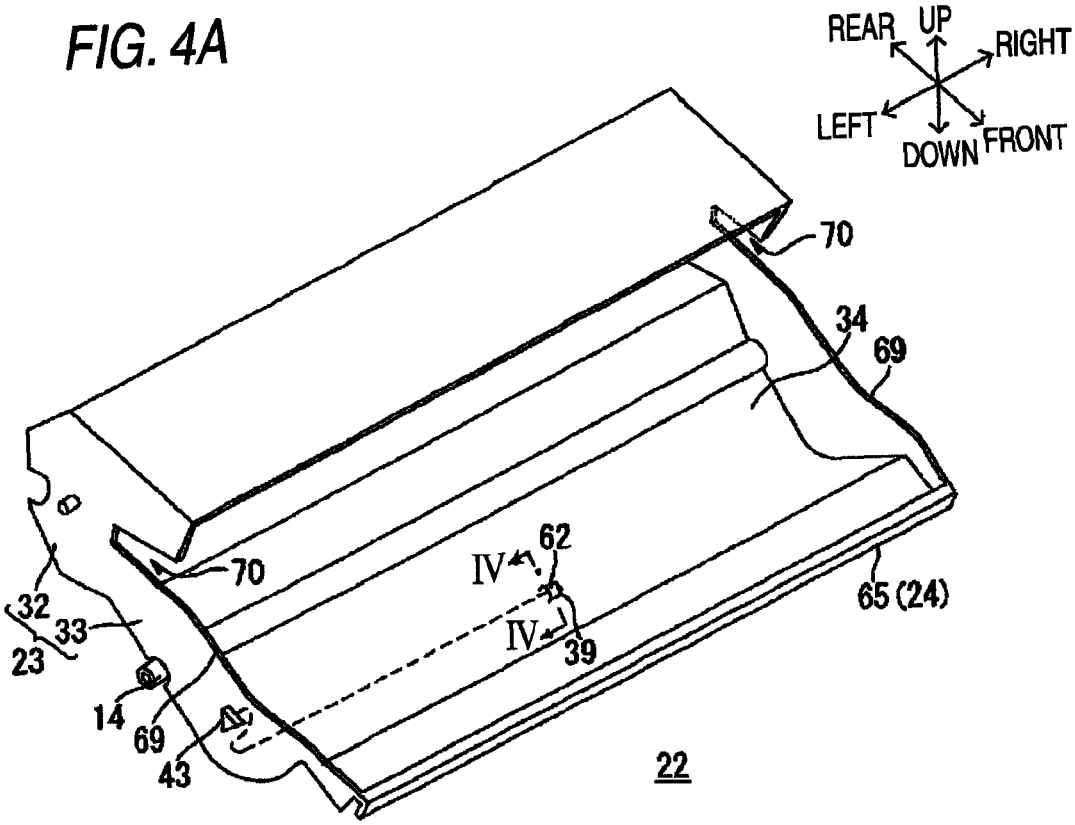
Figure 4B:
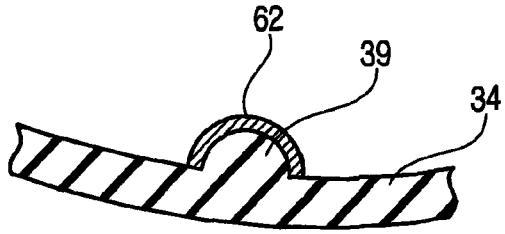
Figure 4C:
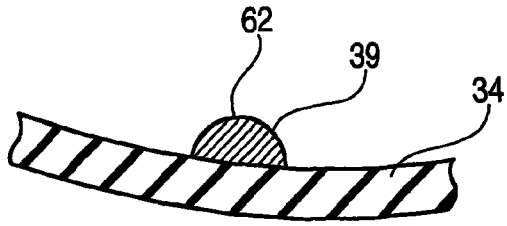

The support portion 39 is not limited to the above-mentioned roller. As shown in FIGS. 4A and 4B, the support portion 39 may be a projection projecting from the bottom wall 34 of the drum cartridge 22 to the side of the developer cartridge 31 (in particular, the upper side). A conductive material is formed on the support portion 39 to form the drum first terminal 62. Accordingly, the support portion 39 can be easily formed and the drum first terminal 62 can be easily provided in the support portion 39. Alternatively, as shown in FIG. 4C, the projection forming the support portion 39 may be formed of a conductive material. That is, the support portion 39 itself serves as the drum first terminal 62.

(5) Modified Example 5

In the embodiment described above, the monochrome laser printer 1 is illustrated. However, for example, the image forming device can also be implemented as a color laser printer (containing tandem type, intermediate transfer type). In the color laser printer, the process cartridges 17 and/or the developer cartridges 31 are provided in a one-to-one correspondence with colors and in each process cartridge 17 and each developer cartridge 31, the rotation moment A and the rotation moment B occurring in each cartridge cause the developing first terminal 44 to be stably connected to the main body first terminal 59.

(6) Modified Example 6

In the modified example 1 described above, the developing first terminal 44 and the developing second terminal 61 electrically connected to the memory device 64 are connected to the corresponding terminals of the main body first terminal 59 and the main body second terminal 60 electrically connected to the CPU (not shown) provided in the main body casing 2. Either of the main body first terminal 59 and the main body second terminal 60 may be grounded through the main body casing 2 without being connected to the CPU (not shown).

What is claimed is:

1. An image forming device comprising:
a main body; and
a first cartridge configured to accommodate a developer and detachably attached to the main body,
wherein the first cartridge comprises:
a rotation body rotatably provided in the first cartridge;
a memory device configured to store information concerning the first cartridge; and
a first terminal electrically connected to the memory device,
wherein the main body comprises:
a driver configured to rotate the rotation body; and
a second terminal electrically connected to the first terminal, and
wherein the first terminal is provided at a position where a torque produced by rotation of the rotation body acts in the first cartridge, and
wherein the first terminal is configured to face downward when the first cartridge is attached to the main body.

2. The image forming device according to claim 1,
wherein the first terminal is provided in an end portion of the first cartridge, the end portion positioned in a vicinity most distant from the rotation body in a rotation radius direction of the rotation body in the first cartridge.

3. The image forming device according to claim 2,
wherein the end portion is a grip portion that allows a user to grip the first cartridge at a time of attaching and detaching the first cartridge.

4. The image forming device according to claim 1,
wherein the rotation body is a photoconductive drum on which an electrostatic latent image is allowed to be formed.

5. The image forming device according to claim 1,
wherein at least one of the first terminal and the second terminal has elasticity.

6. The image forming device according to claim 1,
wherein the first cartridge comprises a third terminal electrically connected to the memory device, and
wherein the main body comprises a fourth terminal configured to abut the third terminal along a direction in which the torque acts.

7. The image forming device according to claim 6,
wherein at least one of the third terminal and the fourth terminal has elasticity.

8. The image forming device according to claim 6,
wherein the main body has an opening that allows the first cartridge to pass through when the first cartridge is attached to or detached from the main body, and comprises a cover member configured to selectively open and close the opening, and
wherein at least one of the second terminal and the fourth terminal is provided at the cover member.

9. The image forming device according to claim 1,
wherein the first terminal contacts the second terminal when the first cartridge is attached to the main body,
wherein the first terminal is provided at the position where the first terminal applies a force toward the second terminal based on the torque.

10. The image forming device according to claim 1, wherein the first terminal is integrated with the memory device.

11. The image forming device according to claim 1, further comprising a tray configured to hold recording media in the main body, wherein the first terminal is configured to face the holder when the first cartridge is attached to the main body.

12. The image forming device according to claim 1, wherein the main body includes a feeding path upon which a recording medium is configured to be fed during an image forming operation, wherein the first terminal is configured to face the feeding path when the first cartridge is attached to the main body.

13. The image forming device according to claim 1, wherein the first cartridge includes a casing having an opening that exposes the rotation body in a particular direction, wherein the first terminal is disposed on the casing and faces the particular direction.

14. An image forming device comprising:
a main body;
a first cartridge configured to accommodate a developer and detachably attached to the main body, and
a second cartridge detachably attachable to the main body, wherein the first cartridge is detachably attachable to the second cartridge,
wherein the first cartridge comprises:
a rotation body rotatable provided in the first cartridge;
a memory device configured to store information concerning the first cartridge; and
a first terminal electrically connected to the memory device, wherein the main body comprises:

a driver configured to rotate the rotation body; and a second terminal electrically connected to the first terminal, wherein the first terminal is provided at a position where a torque produced by rotation of the rotation body acts in the first cartridge, wherein the second cartridge comprises:

a photoconductive drum on which an electrostatic latent image is allowed to be formed; and a third terminal electrically connected to the second terminal, and wherein, when the first cartridge is attached to the second cartridge, the third terminal contacts the first terminal.

15. The image forming device according to claim 14, wherein the second cartridge comprises a support portion that supports the first cartridge attached to the second cartridge, and wherein the third terminal is provided at the support portion.

16. The image forming device according to claim 15, wherein the support portion has a projection portion projected from the second cartridge toward the first cartridge.

17. The image forming device according to claim 15, wherein, the support portion is provided at a center portion in an axial direction of the photoconductive drum.

18. A cartridge detachably attachable to an image forming device that comprises a main body, a driver and a second terminal, said cartridge comprising:

a rotation body allowed to be rotated by the driver when the cartridge is attached to the image forming device;

a memory device configured to store information concerning the cartridge; and a first terminal electrically connected to the memory device, the first terminal being electrically connected to the second terminal when the cartridge is attached to the image forming device, wherein the first terminal is provided at a position where a torque produced by rotation of the rotation body acts in the cartridge, and wherein the first terminal is configured to face downward when the cartridge is attached to the main body.

19. The cartridge according to claim 18, further comprising a casing having an opening that exposes the rotation body in a particular direction, wherein the first terminal faces the particular direction.

* * * * *

UNITED STATES PATENT AND TRADEMARK OFFICE

CERTIFICATE OF CORRECTION

PATENT NO. : 7,953,339 B2
APPLICATION NO. : 12/048538
DATED : May 31, 2011
INVENTOR(S) : Fukamachi et al.

It is certified that error appears in the above-identified patent and that said Letters Patent is hereby corrected as shown below:

Column 14, Claim 14, Line 63:
delete “rotatable” and insert --rotatably--

Signed and Sealed this
Third Day of January, 2012

David J. Kappos

David J. Kappos
*Director of the United States Patent and Trademark Office*